US005735255A

United States Patent [19]

Farmer et al.

[11] Patent Number: 5,735,255

[45] Date of Patent: Apr. 7, 1998

[54] ENGINE CONTROL SYSTEM FOR A LEAN BURN ENGINE HAVING FUEL VAPOR RECOVERY

[75] Inventors: David George Farmer, Plymouth; Gopichandra Surnilla; Daniel V. Orzel, both of Westland, all of Mich.

[73] Assignee: Ford Global Technologies, Inc., Dearborn, Mich.

[21] Appl. No.: 826,602

[22] Filed: Apr. 3, 1997

[51] Int. Cl.[6] ..... F02M 33/02; F02D 41/14

[52] U.S. Cl. ..... 123/698; 123/520

[58] Field of Search ..... 123/519, 520, 123/698, 674

[56] References Cited

U.S. PATENT DOCUMENTS

| | | | |
|---|---|---|---|
| 5,048,493 | 9/1991 | Orzel et al. | 123/698 |
| 5,190,008 | 3/1993 | Yamasaki et al. | 123/306 |
| 5,613,481 | 3/1997 | Kitagawa et al. | 123/698 |
| 5,655,507 | 8/1997 | Kawasaki | 123/674 |
| 5,676,118 | 10/1997 | Saito | 123/520 |
| 5,699,778 | 12/1997 | Muraguchi et al. | 123/698 |

*Primary Examiner*—Thomas N. Moulis

*Attorney, Agent, or Firm*—Allan J. Lippa

[57] ABSTRACT

Fuel vapors are periodically purged from a fuel system into an engine's air/fuel intake. A measurement of the massive inductive fuel vapors is provided by a purge compensation signal is derived from an exhaust gas oxygen sensor output. Lean air/fuel operation is enabled when the purge compensation signal is below a predetermined value.

15 Claims, 6 Drawing Sheets

ENGINE CONTROL SYSTEM FOR A LEAN BURN ENGINE HAVING FUEL VAPOR RECOVERY

BACKGROUND OF THE INVENTION

The field of the invention relates to air/fuel control for engines having a lean burn air/fuel mode and a fuel vapor recovery system coupled between the fuel supply and the engine's air/fuel intake.

Engine air/fuel control systems are known in which fuel delivered to the engine is adjusted in response to the output of an exhaust gas oxygen sensor to maintain average air/fuel ratios at a stoichiometric value. Such systems may also include a fuel vapor recovery system wherein fuel vapors are purged from the fuel system into the engine's air/fuel intake. An example of such a system is disclosed in U.S. Pat. No. 5,048,493.

The inventors herein have discovered numerous problems when prior air/fuel control systems are employed with engines having a lean burn operating mode. Such engines will operate at air/fuel ratios substantially leaner than stoichiometry to achieve improved fuel economy. However, when fuel vapors are purged into the engine air/fuel intake during lean burn operating modes, the engine will not run as lean as it is capable of running and fuel economy will therefore not be maximized.

SUMMARY OF THE INVENTION

An object of the invention herein is to purge fuel vapors from an engine fuel system into the engine air/fuel intake while maintaining engine operation at a desired lean air/fuel ratio during lean burn operating modes.

The above object is achieved and problems with prior approaches overcome by providing an apparatus and a control method for controlling air/fuel operation of an engine coupled to a fuel system. In one particular aspect of the invention, the method comprises the steps of: purging air through the fuel system to purge a mixture of the air and any fuel vapors from the fuel system into an air/fuel intake of the engine; providing an indication of fuel vapor presence during the purging step; and enabling operation of the engine at an air/fuel ratio lean of a stoichiometric air/fuel ratio when the fuel vapor indication is below a predetermined value.

An advantage of the above aspect of the invention is that lean air/fuel operation can be provided at a desired lean value while accommodating the purging of fuel vapors from the fuel system.

BRIEF DESCRIPTION OF THE DRAWINGS

The above object is achieved, problems of prior approaches overcome, and advantages obtained, by the embodiment in which the invention is used to advantage as now described with reference to the attached drawings wherein.

DESCRIPTION OF AN EMBODIMENT

Figure 1:
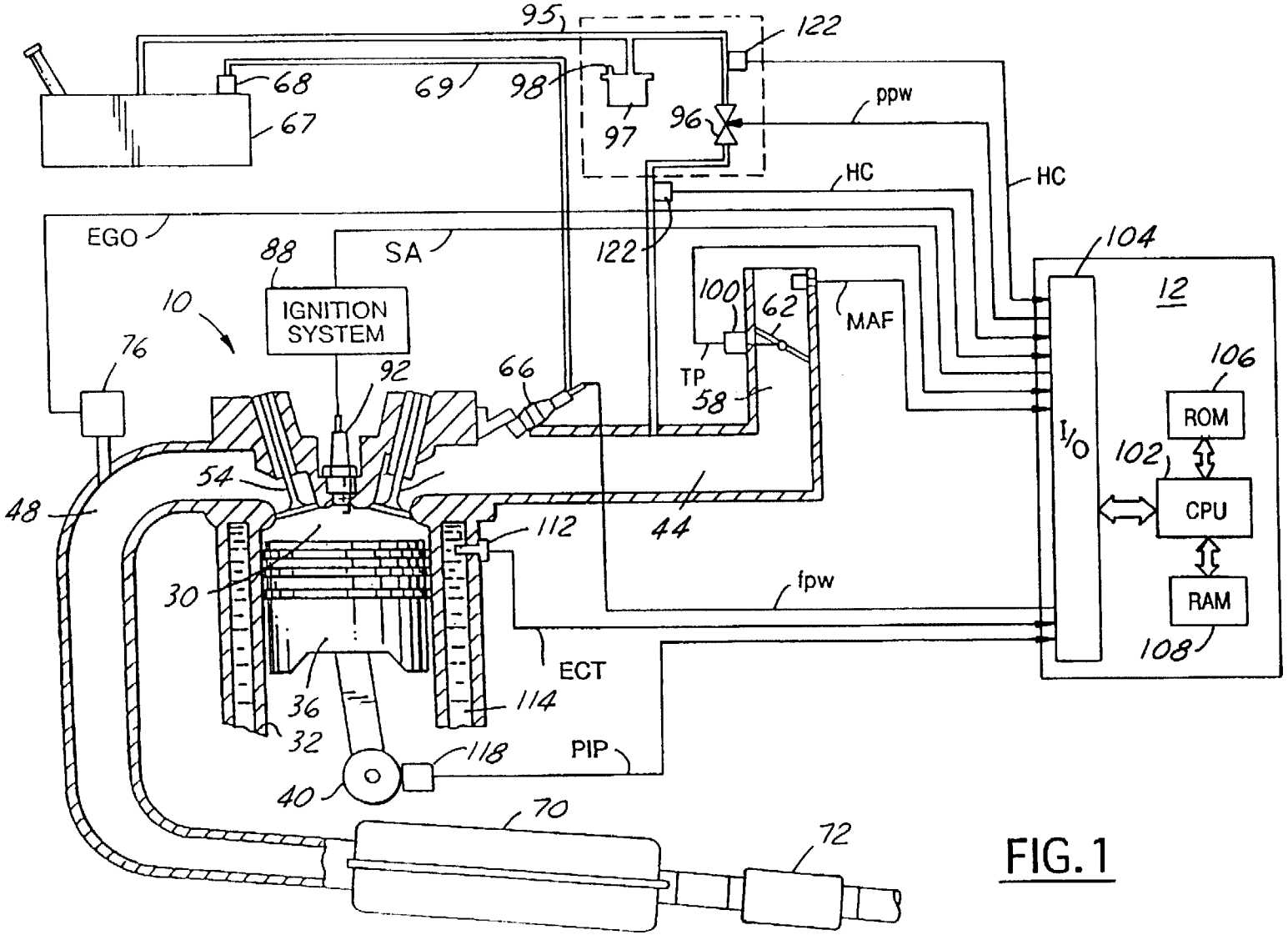
FIG. 1 is a block diagram of an embodiment in which the invention is used to advantage.

Internal combustion engine 10 comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Intake manifold 44 is shown communicating with throttle body 58 via throttle plate 62. Intake manifold 44 is also shown having fuel injector 66 coupled thereto for delivering liquid fuel in proportion to the pulse width of signal fpw from controller 12. Fuel is delivered to fuel injector 66 by a conventional fuel system including fuel tank 67, fuel pump 68, and fuel rail 69.

Catalytic converter 70 is shown coupled to exhaust manifold 48 upstream of nitrogen oxide trap 72. Exhaust gas oxygen sensor 76 is shown coupled to exhaust manifold 48 upstream of catalytic converter 70. In this particular example, sensor 76 provides signal EGO to controller 12 which converts signal EGO into two-state signal EGOS. A high voltage state of signal EGOS indicates exhaust gases are rich of a desired air/fuel ratio and a low voltage state of signal EGOS indicates exhaust gases are lean of the desired air/fuel ratio. Typically, the desired air/fuel ratio is selected at stoichiometry (14.3 lb. of air per pound of fuel, for example) which falls within the peak efficiency window of catalytic converter 70. During lean burn air/fuel operating modes, the desired air/fuel ratio is selected at a desired lean value considerably leaner than stoichiometry (18–22 lb. of air per pound of fuel, for example) to achieve improved fuel economy.

Fuel vapor recovery system 94 is shown coupled between fuel tank 67 and intake manifold 44 via purge line 95 and purge control valve 96. In this particular example, fuel vapor recovery system 94 includes vapor canister 97 which is connected in parallel to fuel tank 67 for absorbing fuel vapors therefrom by activated charcoal contained within the canister. Further, in this particular example, valve 96 is a pulse width actuated solenoid valve responsive to pulse width signal ppw from controller 12. A valve having a variable orifice may also be used to advantage such as a control valve supplied by SIEMENS as part no. F3DE-9C915-AA.

During fuel vapor purge, air is drawn through canister 97 via inlet vent 98 absorbing hydrocarbons from the activated charcoal. The mixture of purged air and vapors is then inducted into intake manifold 44 via purge control valve 96. Concurrently, fuel vapors from fuel tank 67 are drawn into intake manifold 44 via purge control valve 96.

Controller 12 is shown in FIG. 1 as a conventional microcomputer including: microprocessor unit 102, input/output ports 104, an electronic storage medium for executable programs and calibration values shown as read only memory chip 106 in this particular example, random access memory 108, and a conventional data bus. Controller 12 is shown receiving various signals from sensors coupled to engine 10, in addition to those signals previously discussed, including: measurement of inducted mass air flow (MAF) from mass air flow sensor 110 which is coupled to throttle body 58; engine coolant temperature (ECT) from temperature sensor 112 coupled to cooling sleeve 114; a profile ignition pickup signal (PIP) from Hall effect sensor 118 coupled to crankshaft 40; throttle position signal TP from throttle position sensor 120; and signal HC from hydrocarbon sensor 122 coupled between purge valve 96 and intake manifold 44.

Figure 2:
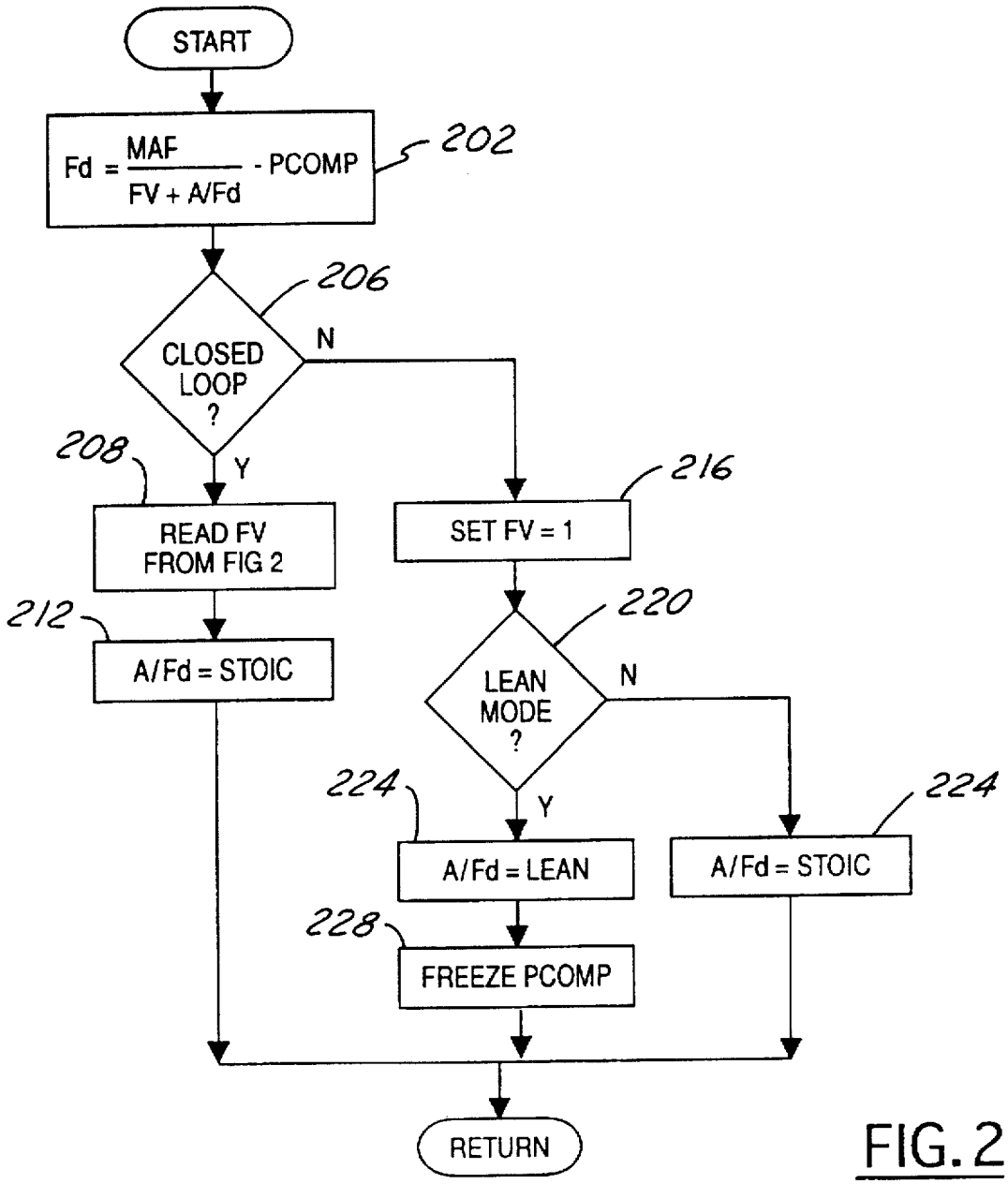
FIGS. 2–6 are high level flowcharts illustrating various steps performed by a portion of the embodiment shown in FIG. 1.

The liquid fuel delivery routine executed by controller 12 for controlling engine 10 is now described beginning with reference to the flowchart shown in FIG. 2. Fuel delivery signal Fd, which is subsequently converted to fuel pulse width signal fpw for actuating fuel injector 66, is first generated as shown in step 202. More specifically, measurement of inducted mass airflow MAF is divided by the product of feedback variable FV (which is generated by the flowchart shown in FIG. 3) and desired air/fuel ratio A/Fd. Purge compensation signal PCOMP (the generation of which is described later herein with particular reference to the flowchart shown in FIG. 4) is then subtracted from the above quotient. Purge compensation signal PCOMP provides a measurement of the mass of fuel vapors inducted from fuel vapor recovery system 94 into air/fuel intake manifold 44 of engine 10.

Closed-loop or feedback air/fuel conditions are then checked during step 206 such as engine coolant temperature ECT being above a threshold value. When feedback control conditions are present, feedback variable FV is read from the subroutine shown in FIG. 3 (step 208). And desired air/fuel ratio A/Fd is set equal to a stoichiometric air/fuel ratio such as 14.3 lb. of air per pound of fuel (step 212).

On the other hand, when feedback control conditions are not present (step 206), feedback variable FV is set equal to a value corresponding to a stoichiometric air/fuel ratio. Such value is unity in this particular example (step 216).

When controller 12 is not causing air/fuel operation in either the closed-loop mode (step 206) or the lean burn mode (step 220), desired air/fuel ratio A/Fd is set equal to the stoichiometric air/fuel ratio (step 224). When not operating in the feedback control mode (step 206), but when operating in the lean air/fuel ratio mode (step 220), desired air/fuel ratio A/Fd is set equal to a preselected value which typically ranges between 18 and 22 lb. of fuel per pound of air. In some applications, however, such as those encountered in direct injection engines utilizing stratified fuel charges, the desired air/fuel ratio A/Fd may be as lean as approximately 40 or 50 pounds of air per pound of fuel.

Continuing with FIG. 2, when not operating in the feedback control mode (step 206), but while operating in the lean mode (step 220), purge compensation signal PCOMP is frozen at the last value it had when operating during feedback air/fuel control (step 228).

Figure 3:
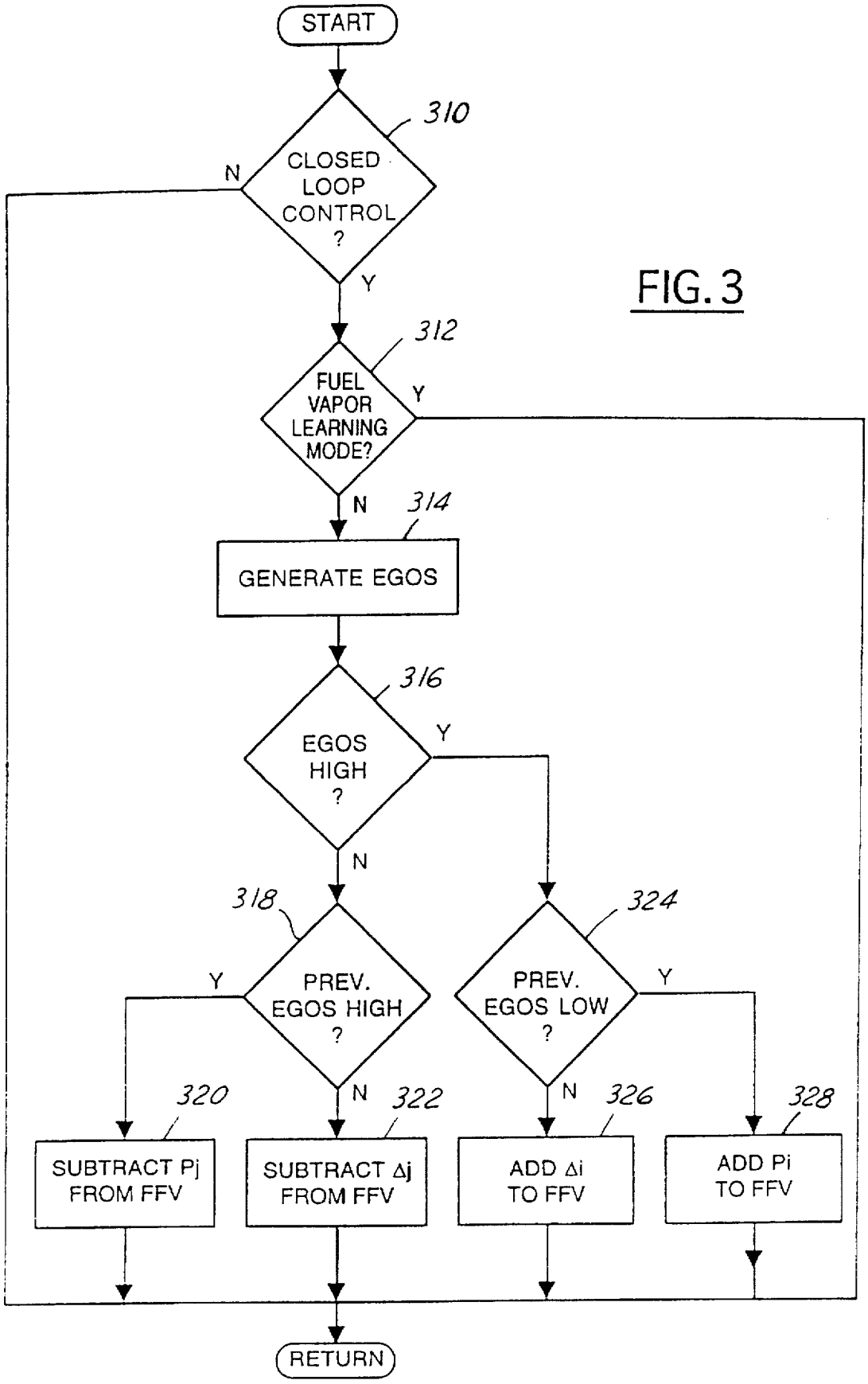

The air/fuel feedback routine executed by controller 12 to generate fuel feedback variable FV is now described with reference to the flowchart shown in FIG. 3. This subroutine will proceed only when feedback control or closed-loop control conditions are present (step 310) and controller 12 is not in the fuel vapor learning mode (step 312). The fuel vapor learning mode is described in greater detail later herein with particular reference to FIG. 4. When the above conditions are satisfied, two-state signal EGOS is S generated from signal EGO (step 314) in the manner previously described herein with reference to FIG. 1. Preselected proportional term Pj is subtracted from feedback variable FV (step 320) when signal EGOS is low (step 316), but was high during the previous background loop of controller 12 (step 318). When signal EGOS is low (step 316), and was also low during the previous background loop (step 318), preselected integral term Δj is subtracted from feedback variable FV (step 322).

Similarly, when signal EGOS is high (step 316), and was also high during the previous background loop of controller 12 (step 324), integral term Δi is added to feedback variable FV (step 326). When signal EGOS is high (step 316), but was low during the previous background loop (step 324), proportional term Pi is added to feedback variable FV (step 328).

In accordance with the above described operation, feedback variable FV is generated from a proportional plus integral controller (P1) responsive to exhaust gas oxygen sensor 76. The integration steps for integrating signal EGOS in a direction to cause a lean air/fuel correction are provided by integration steps Δi, and the proportional term for such correction provided by Pj. Similarly integral term Δj and proportional term Pj cause rich air/fuel correction.

Figure 4:
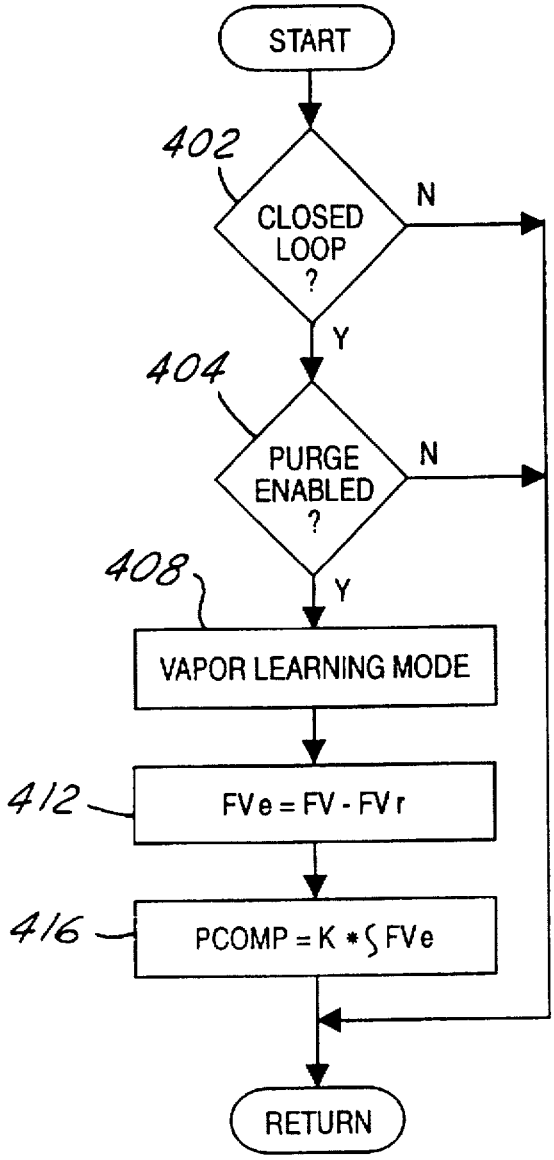

Description of the fuel vapor learning mode in which purge compensation signal PCOMP is generated is now described with particular reference to FIG. 4. More specifically, when both closed-loop or feedback control air/fuel conditions are present (step 402) and fuel vapor purge of fuel vapor system 94 is enabled (step 404), the fuel vapor learning mode is entered (step 408).

Feedback variable error signal FVe is generated by subtracting reference feedback variable FVr from feedback variable FV (step 412). Reference feedback variable FVr is the value which is associated with stoichiometric combustion. In this particular example, reference feedback variable FVr is set equal to unity. Purge compensation signal PCOMP is then generated by integrating feedback error signal FVe and multiplying the integral by gain constant k (step 416).

Figure 5:
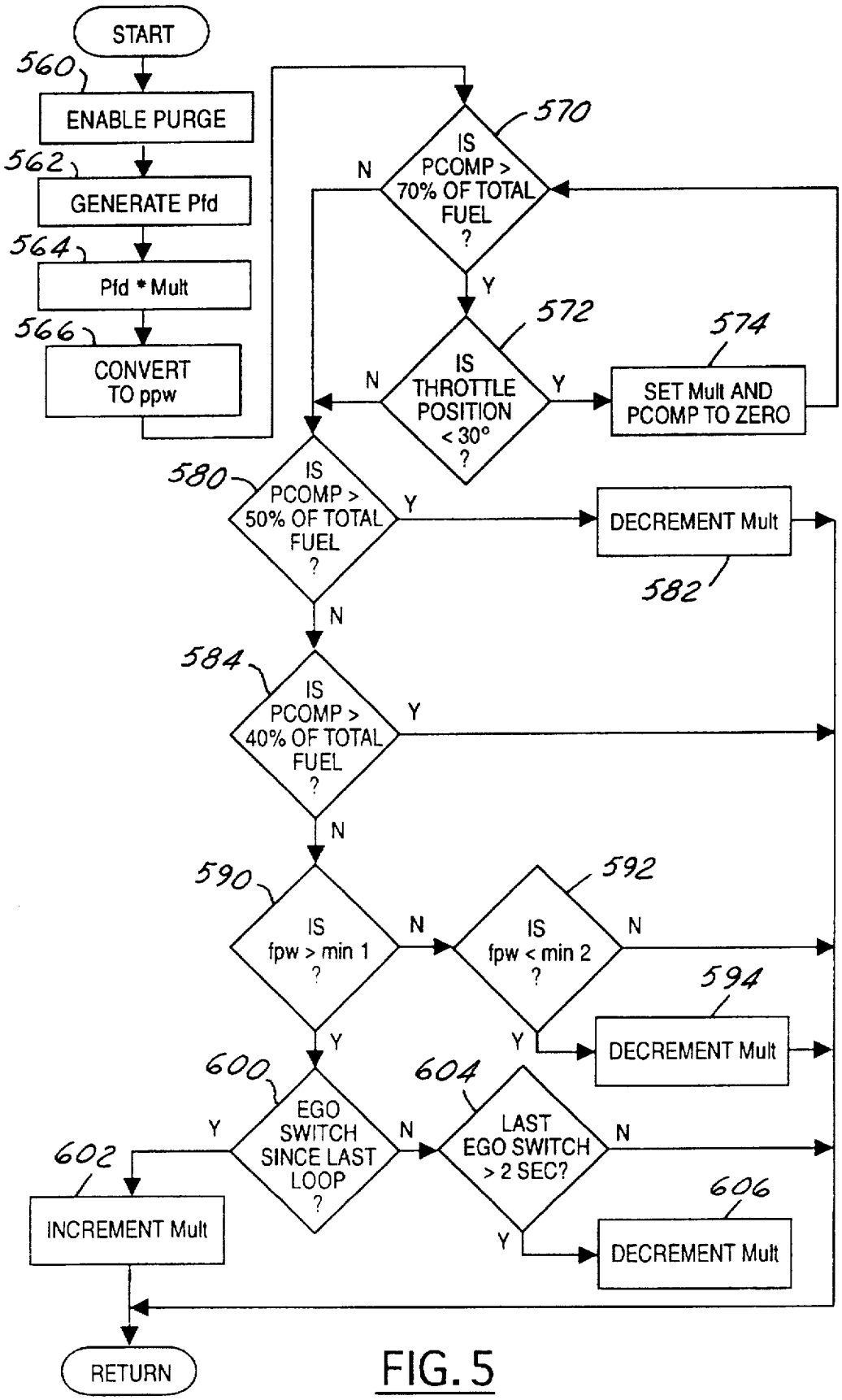

Controlling the rate of fuel vapor flow is now described in more detail with reference to FIG. 5 and FIGS. 6A–6F. Referring first to FIG. 5, purge is enabled as a function of engine temperature during step 560. Desired purge flow signal Pfd is generated during step 562. In this particular example, signal Pfd is the maximum purge flow obtainable through purge control valve 96 (i.e., 100% duty cycle) to prevent emissions of hydrocarbons, operate engine 10 more efficiently, and reduce fuel system pressure. Unlike prior approaches, maximum purge flow is obtainable without exceeding the operating range of authority of air/fuel feedback control.

During step 564, signal Pfd is multiplied by a scaling factor shown as signal Mult. As described in greater detail below, signal Mult is incremented in predetermined steps to maximum value of unity for controlling the turn on of purge flow. The product Pfd * Mult is converted to the corresponding pulse width modulated signal ppw in step 566. For example, if signal Mult is 0.5, signal ppw is generated with a 50% duty cycle.

During steps 570–574, purge is disabled under sudden deceleration conditions when there is an appreciable fuel vapor concentration to prevent temporary driveability problems. More specifically, a determination of whether fuel vapors comprise more than 70% of total fuel (fuel vapor plus liquid fuel) is made during step 570. In this particular example, signal PCOMP is divided by the sum of signal Fd plus signal PCOMP. If this ratio is greater than 70%, and the throttle position is less than 30°, (see step 572), then purge is disabled by setting signal Mult and signal PCOMP to zero (see step 574). However, if the ratio PCOMP/(Fdm+PCOMP) is less than 70%, or throttle position is greater than 30°, the process continues with step 580.

During steps 580 and 582, signal Mult is decremented a predetermined amount if the fuel vapor contribution of total fuel is greater than 50%. When the fuel vapor contribution is less than 50%, but greater than 40%, the program is exited without further changes to signal Mult (see step 584) such that the rate of purge flow remains the same. When fuel vapor concentration is less than 40% of total fuel, the program advances to step 590. It is noted that the functions performed by steps 580–584 may be accomplished by other means. For example, a simple comparison of signal PCOMP to various preselected values may also be used to advantage for either decrementing purge flow during initiation of purging operations, or holding it constant, when there are high concentrations of fuel vapors.

During step 590, fuel injector pulse width signal fpw is compared to a first minimum value (min1) which defines an upper level of a pulse width dead band. If signal fpw is greater than min1, processing continues with program step 600. On the other hand, when signal fpw is less than min1, but greater than a minimum pulse width associated with the lower level of such dead band (min2), the rate of purge flow is not altered and the program exited (see step 592). Under such conditions the fuel injector pulse width signal fpw is within the dead band. However, when signal fpw is less than min2, the rate of purge flow is decremented a predetermined amount by drecementing signal Mult a corresponding predetermined amount (see steps 592 and 594).

When fuel injector pulse width signal fpw is above the dead band (i.e., greater than min1) the program continues with steps 600–606. Signal Mult is incremented a predetermined amount when signal EGO has switched states since the last program background loop (see steps 600 and 602). If there has not been an EGO switch during a predetermined time, such as two seconds, signal Mult is decremented by a predetermined time (see steps 602 and 606). However, if there has been an EGO switch during such predetermined time, the rate of purge flow remains the same (see step 604). Accordingly, during initiation of the purging process, the rate of purge flow is gradually increased with each change in state of exhaust gas oxygen sensor 76. In this manner, purge flow is turned on at a gradual rate to its maximum value (i.e., signal Mult incremented to united when indications (EGO switching) are provided indicating that air/fuel feedback control and fuel vapor control are properly compensating for purging of fuel vapors.

Figure 6:
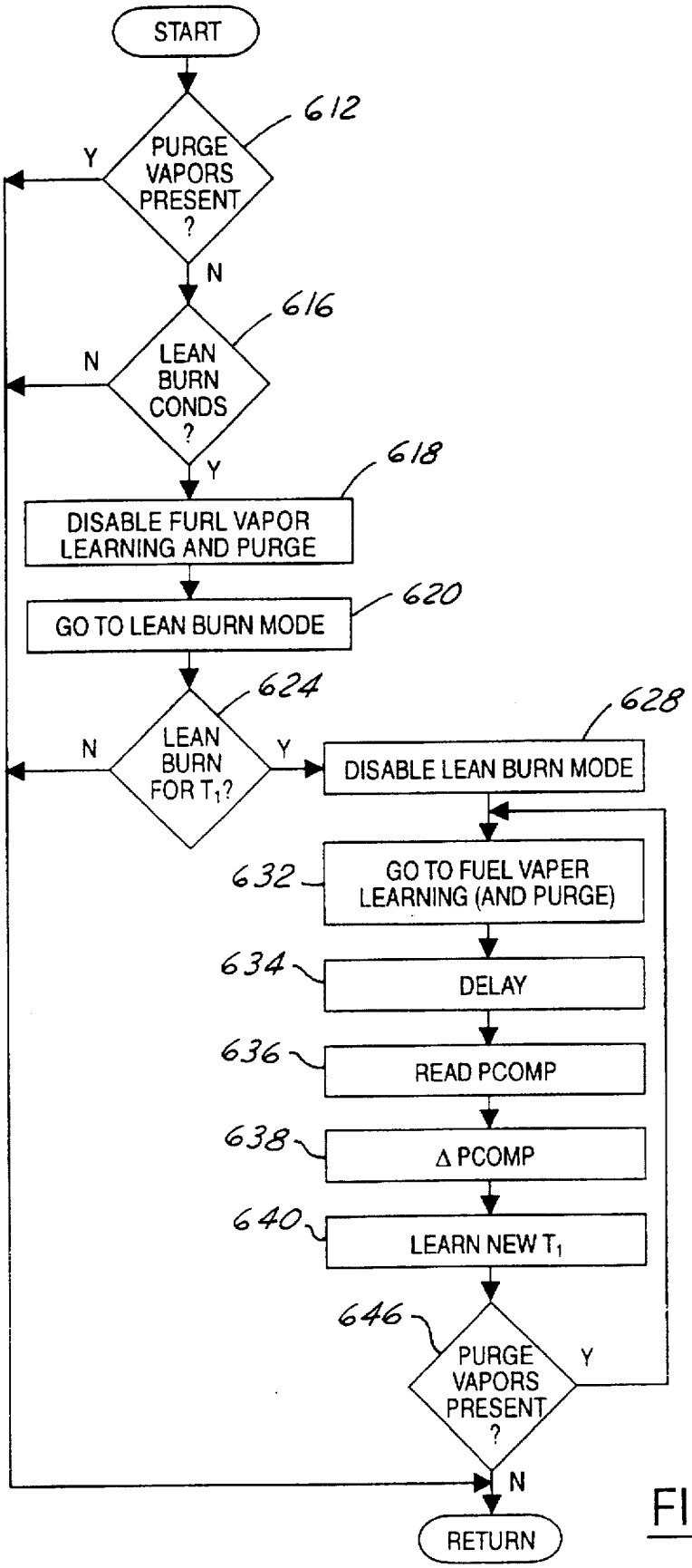

Referring now to FIG. 6, switching between the lean burn mode and the fuel vapor learning mode is now described. The lean burn air/fuel operating mode is entered (step 620) when purged fuel vapors are negligible or below a preselected value (step 612) and lean burn operating conditions are present (step 616). Lean burn operating conditions include operations such as when engine 12 is not accelerating. An indication of the presence of purged fuel vapors (step 612) is provided in this particular example when purge compensation signal PCOMP is at a low value or zero. Other parameters indicative of the presence of fuel vapors in the purged mixture from fuel vapor recovery system 94 may be used to advantage such as feedback variable FV being at a value different from unity or a range about unity. Still another indication may be provided from a hydrocarbon sensor positioned in the purge vapor lines such as hydrocarbon sensor 122.

When engine 10 has been operating in the lean burn mode for time period T1 (step 624), the lean burn mode is disabled (step 628) and the fuel vapor learning mode enabled (step 632) to determine whether fuel vapors are present in the fuel system. When an indication is provided that fuel vapors are present, such as when purge compensation signal PCOMP is greater than zero, the fuel vapor learning mode continues (steps 632 and 636). Stated another way, engine 10 continues to operate in the closed-loop or feedback air/fuel control mode wherein fuel vapors are purged from fuel vapor recovery system 94 into engine air/fuel intake 44. When fuel vapors are no longer present or are at a preselected threshold (step 636), the routine continues and will enter the lean burn mode when lean operating conditions are satisfied (step 612, 616, and 620).

This concludes the description of an example of operation in which the invention is used to advantage. The reading of it by those skilled in the art will bring to mind many modifications and alterations without departing from the spirit and scope of the invention. Accordingly, it is intended that the invention be limited only by the following claims.

What is claimed:

1. A control method controlling air/fuel operation of an engine coupled to a fuel system, comprising the steps of:

purging air through the fuel system to purge a mixture of said air and any fuel vapors from the fuel system into an air/fuel intake of the engine;

providing an indication of fuel vapor presence during said purging step; and enabling operation of the engine at an air/fuel ratio lean of a stoichiometric air/fuel ratio when said fuel vapor indication is below a predetermined value.

2. The method recited in claim 1 wherein said step of providing a fuel vapor indication is responsive to a feedback variable generated from an output of an exhaust gas oxygen sensor.

3. The method recited in claim 2 wherein said step of providing a fuel vapor indication is responsive to an error signal related to a difference between said feedback variable and a reference value associated with a stoichiometric air/fuel ratio.

4. The method recited in claim 1 wherein said step of providing a fuel vapor indication is responsive to a hydrocarbon sensor communicating with said purged mixture.

5. A control method controlling air/fuel operation of an engine by delivering fuel to an engine air/fuel intake from a fuel system in response to a fuel delivery signal, comprising the steps of:

purging air through the fuel system to purge a mixture of said air and fuel vapors from the fuel system into an air/fuel intake of the engine;

adjusting the fuel delivery signal in response to a feedback signal indicative of engine air/fuel operation to maintain average engine air/fuel operation at a stoichiometric air/fuel ratio during a feedback control mode;

providing an indication of fuel vapor presence in said purged mixture entering said air/fuel intake during said feedback control mode;

disabling said purging step and enabling engine air/fuel operation lean of said stoichiometric air/fuel ratio during a lean burn mode when said fuel vapor indication is below a predetermined value; and disabling said lean burn mode and enabling said feedback control mode at preselected times to determine whether fuel vapors are present via said fuel vapor indication step.

6. The method recited in claim 5 wherein said step of providing an indication of fuel vapor presence is responsive to a fuel vapor measuring signal derived from said feedback variable.

7. The method recited in claim 6 wherein said adjusting step is further responsive to said fuel vapor measuring signal so that said fuel vapor measuring signal reduces the fuel delivery signal which causes said feedback variable to be driven to a value corresponding to a stoichiometric air/fuel ratio.

8. The method recited in claim 6 wherein said fuel vapor measuring signal is derived from an error signal related to a difference between said feedback variable and a reference value associated with said stoichiometric air/fuel ratio.

9. The method recited in claim 5 wherein said step of providing an indication of fuel vapor presence is responsive to said feedback variable.

10. The method recited in claim 5 wherein said purging step is disabled during said lean burn mode.

11. A control method controlling air/fuel operation of an engine by delivering fuel to an engine air/fuel intake from a fuel system in response to a fuel delivery signal, comprising the steps of:

purging air through the fuel system to purge a mixture of said air and fuel vapors from the fuel system into an air/fuel intake of the engine;

providing an indication of fuel vapor presence in said purged mixture entering said air/fuel intake in response to an exhaust gas oxygen sensor during an air/fuel feedback control mode;

disabling said purging step and enabling engine air/fuel operation lean of a stoichiometric air/fuel operation during a lean burn mode when said fuel vapor indication is below a predetermined value;

disabling said lean burn mode and enabling said feedback control mode at preselected times to determine whether fuel vapors are present via said fuel vapor indication step; and adaptively learning said preselected time as a function of said fuel vapor indication.

12. The method recited in claim 11 wherein said adaptively learning step further comprises sampling said fuel vapor indication after disabling said lean mode and enabling said feedback control mode.

13. The method recited in claim 11 wherein said adaptively learning step further comprises a step of determining decay in said fuel vapor indication after disabling said lean mode and enabling said feedback control mode.

14. An article of manufacture comprising:

a computer storage medium having a computer program encoded therein for causing a computer to control air/fuel operation of an engine by generating a fuel delivery signal for delivering fuel to an engine air/fuel intake from a fuel system, said computer storage medium comprising:

purging code means for causing a computer to purge air through the fuel system to purge a mixture of said air and any fuel vapors from the fuel system into an air/fuel intake of the engine;

adjusting code means for causing a computer to adjust the fuel delivery signal in response to a feedback signal indicative of engine air/fuel operation to maintain average engine air/fuel operation at a stoichiometric air/fuel ratio during a feedback control mode;

indicating code means for causing a computer to provide an indication of fuel vapor presence in said purged mixture during said air/fuel feedback control mode;

enabling code means for causing a computer to enable engine air/fuel operation lean of a stoichiometric air/fuel operation during a lean burn mode when said fuel vapor indication is below a predetermined value; and checking code means for causing a computer to periodically disable said lean mode and enable said feedback control mode to determine whether fuel vapors are present via said fuel vapor indication step.

15. The article of manufacture recited in claim 14 wherein said computer storage medium comprises a memory chip.

* * * * *